United States Patent [19]

Kawakami

[11] 4,129,104

[45] Dec. 12, 1978

[54] IGNITION TIMING CONTROL DEVICE OF THE NEGATIVE PRESSURE ACTUATION TYPE

[75] Inventor: Kazuhiko Kawakami, Katsuta, Japan

[73] Assignee: Hitachi, Ltd., Japan

[21] Appl. No.: 715,155

[22] Filed: Aug. 17, 1976

[30] Foreign Application Priority Data

Aug. 25, 1975 [JP] Japan ..... 50-102166

[51] Int. Cl.[2] ..... F02P 5/06

[52] U.S. Cl. ..... 123/117 A; 123/146.5 A; 200/31 V

[58] Field of Search ..... 123/117 A, 146.5 A; 200/31 V

[56] References Cited

U.S. PATENT DOCUMENTS

| | | | |
|---|---|---|---|
| 3,521,609 | 8/1967 | Kashiwagi et al. | 123/117 A |
| 3,650,253 | 3/1972 | Cooksey | 123/117 A |
| 3,718,126 | 2/1973 | Oishi et al. | 123/117 A |
| 3,788,290 | 1/1974 | Carter et al. | 123/117 A |
| 3,895,616 | 7/1975 | Steinke | 123/117 A |
| 3,978,831 | 9/1976 | Yoshikawa | 123/117 A |

*Primary Examiner*—Charles J. Myhre
*Assistant Examiner*—P. S. Lall
*Attorney, Agent, or Firm*—Craig & Antonelli

[57] ABSTRACT

In an ignition timing control device of the negative pressure actuation type having a diaphragm secured to a rod connected to an ignition timing adjusting plate having an ignition signal generating means mounted thereon, the diaphragm being held between two diaphragm cases to define first and second diaphragm chambers therebetween, and a negative pressure introducing port formed in the diaphragm case defining the first diaphragm chamber and communicating with a negative pressure source so as to introduce a negative pressure into the first diaphragm chamber to operate the ignition timing adjusting plate to effect ignition advance or ignition lag, an empty space is formed at the entrance to the diaphragm case defining the first diaphragm chamber for housing therein an electrically operated valve and maintained in communication with the first diaphragm chamber, and the empty space communicates with the negative pressure introducing port through a negative pressure communication opening and with the atmosphere through an atmospheric pressure introducing port, so that communication between the negative pressure communication opening and the empty space is shut off at predetermined engine operating conditions and communication between the atmospheric pressure introducing port and the empty space is shut off at other engine operating conditions by means of the valve.

5 Claims, 2 Drawing Figures

IGNITION TIMING CONTROL DEVICE OF THE NEGATIVE PRESSURE ACTUATION TYPE

BACKGROUND OF THE INVENTION

This invention relates to ignition timing control devices of the negative pressure actuation type having the function of effecting ignition lag behind normal ignition timing to reduce noxious components of the exhausts and avoid air pollution when the engine idles or reduces its speed, and more particularly to an ignition timing control device of the type described in which separate pressure signals are supplied to a single diaphragm when ignition advance and ignition lag are effected to thereby control ignition timing.

In one form of control device of this type of the prior art, a negative pressure prevailing on the upstream side of the throttle valve mounted in the carburetor is applied to one of two diaphragm chambers formed on both sides of a single diaphragm and a negative pressure prevailing on the downstream side thereof is applied to the other diaphragm chamber, and an electromagnetic change-over valve is mounted midway of each of negative pressure passages, with the two electromagnetic change-over valves being operated such that the diaphragm chamber at which the negative pressure on the downstream side of the throttle valve is applied is communicated with the atmosphere when ignition advance is effected and the diaphragm chamber at which the negative pressure on the upstream side thereof is applied is communicated with the atmosphere when ignition lag is effected, whereby ignition signal generating means for the distributor can be controlled. In another form of control device of this type of the prior art, there are provided a plunger of an electromagnet means disposed on one side of a single diaphragm, and a spring disposed on the other side of the diaphragm and adapted to press by its biasing force the diaphragm against the plunger, a negative pressure prevailing on the upstream side of the throttle valve being applied to the diaphragm so as to cause the same to operate by overcoming the biasing force of the spring when ignition advance is effected and said plunger being actuated to move the diaphragm by the biasing force of the spring in a direction opposite to the direction in which it moves in effecting ignition advance when ignition lag is effected, whereby the ignition signal generating means can be controlled.

The former control device requires two electromagnetic valves for switching between the negative pressures for operating the diaphragm. Because of this, the device requires an undesirable multiplicity of parts and is high in cost. Also it is impossible to mount the control device with a high degree of efficiency because the piping system for the supply of negative pressure is complicated.

On the other hand, the latter control device comprises a single electromagnet means and a diaphragm, so that it requires a smaller number of parts and is lower in cost than the former device. Moreover, since all the component parts can be mounted as a unitary structure, the latter device is compact in size and can be mounted readily. However, some disadvantages are associated with the latter device. It is necessary to exert a force on the spring in a manner to prevent inadvertent movement of the plunger which would otherwise be caused by the spring when the diaphragm is operated to effect ignition advance. This makes it necessary to design the plunger actuating electromagnet means such that it can develop a force which is commensurate to the biasing force of the spring. Thus, the spring load should be in the range between 0.5 and 1.0 kg to enable the ignition signal generating means to positively operate with about a 10° lag. If a current passed to the electromagnet means is about 1 A, the winding of the electromagnet means will be about 40 mm in diameter and 40 mm in length. This will make it impossible to mount for practical purposes the control device on the distributor which has the ignition signal generating means mounted thereon. Moreover, in this device, the pressure available for actuating the diaphragm in shifting the device from an ignition advance position to an ignition lag position is only about 100 mmHg. Therefore, the device is low in its ability to respond to a negative pressure signal.

SUMMARY OF THE INVENTION

An object of this invention is to provide an ignition timing control device of the negative pressure actuation type adapted to effect ignition advance or ignition lag, wherein shifting of the device between an ignition advance position and an ignition lag position can be effected with the use of a minimum number of component parts.

Another object is to provide a compact ignition timing control device of the negative pressure actuation type which can be readily mounted on the distributor and which requires no more space than is necessary.

Still another object is to provide an ignition timing control device of the negative pressure actuation type which is highly responsive to a negative signal when switching between an ignition advance position and an ignition lag position is effected.

The outstanding characteristics of the invention are that a diaphragm secured to a rod connected to an ignition timing adjusting plate having mounted thereon an ignition signal generating means is held between two diaphragm cases to define first and second diaphragm chambers, the diaphragm case defining the first diaphragm chamber is formed therein with a negative pressure introducing port communicating with a negative pressure source, an empty space is formed at the entrance to the negative pressure introducing port housing therein an electrically operated valve means and communicating with the first diaphragm chamber, and a negative pressure communication opening for communicating the empty space with the negative pressure introducing port and an atmospheric pressure introducing port for communicating the empty space with the atmosphere are provided, so that the communication between the negative pressure communicating opening and the empty space is shut off at predetermined engine operating conditions and the communication between the atmospheric pressure introducing port and the atmosphere is shut off at other engine operating conditions by the action of the valve.

DETAILED DESCRIPTION OF THE PREFERRED EMBODIMENT

The ignition timing control device comprising a preferred embodiment of the invention will be described in order of its assembling with reference to the accompanying drawings.

Figure 2:
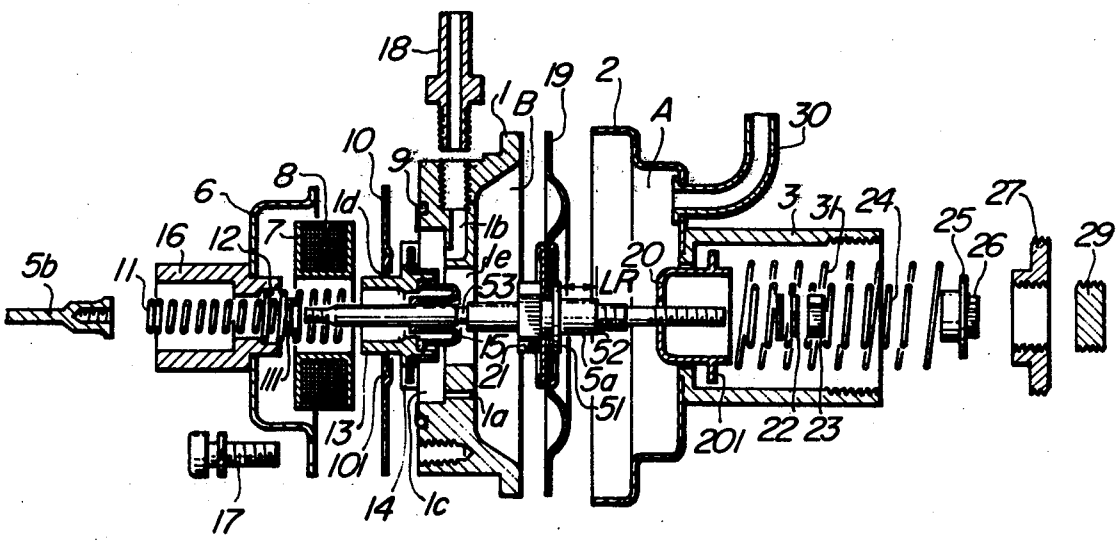
FIG. 2 is an exploded sectional view of the ignition timing control device shown in FIG. 1.

In FIG. 2, a rod 5*a* extending through the center of a diaphragm 19 and disposed on opposite sides thereof is secured to the central portion of the diaphragm 19 by means of a nut 21 in airtight relation.

Substantially bowl-shaped cases 1 and 2 are assembled with the diaphragm 19 in such a manner that the cases 1 and 2 hold the diaphragm 19 therebetween with each case being in contact with one side of the diaphragm along the entire outer periphery thereof. The outer marginal portion of the case 2 is folded tightly over the outer marginal portion of the case 1 so that the cases 1 and 2 and the diaphragm 19 can be formed into a unitary structure. Thus, diaphragm chambers A and B are defined on opposite sides of the diaphragm 19 between the cases 1 and 2 and the diaphragm 19. The rod 5*a* extends through the central portions of the cases 1 and 2 and projects outwardly of the outer sides thereof.

The bowl-shaped diaphragm case 2 has secured to its bottom a conduit 30 for communicating the diaphragm chamber A with the outside and a spring housing 3 disposed adjacent the conduit 30.

A washer 22 is held in place by means of a nut 23 in an offset portion 52 of the rod 5*a* which is spaced apart from a flange 51 of the rod 5*a* a distance LR, after the rear end portion of the rod 5*a* is inserted in the washer 22.

The spring housing 3 is cylindrical in shape and secured to the underside of the bottom of the case 2 in such a manner that the rear end portion of the rod 5*a* projecting from the case 2 is aligned with the center axis of the spring housing 3.

A spring seat 20 is inserted through the open end of the spring housing 3 into the diaphragm chamber A in such a manner that a flange 201 of the spring seat 20 is brought into abutting engagement with the underside of the bottom of the spring housing 3.

A first spring 24 is mounted in a space about the rod 5*a* and brought at one end thereof into engagement with the spring seat 20, and the rear end portion of the rod 5*a* is inserted in a washer 25 until the latter is brought into abutting engagement with the other end of the first spring 24. Thereafter, a nut 26 is threadably fitted to the rear end of the rod 5*a* so as to support the spring 24 about the rod 5*a*.

A second spring 31 of a larger diameter than the first spring 24 is mounted in the spring housing 3 in such a manner that one end of the spring 31 is positioned against the flange 201 of the spring seat 20, and a spring seat 27 for seating the other end of the spring 31 is threadably attached to the open end of the spring housing 3.

Figure 1:
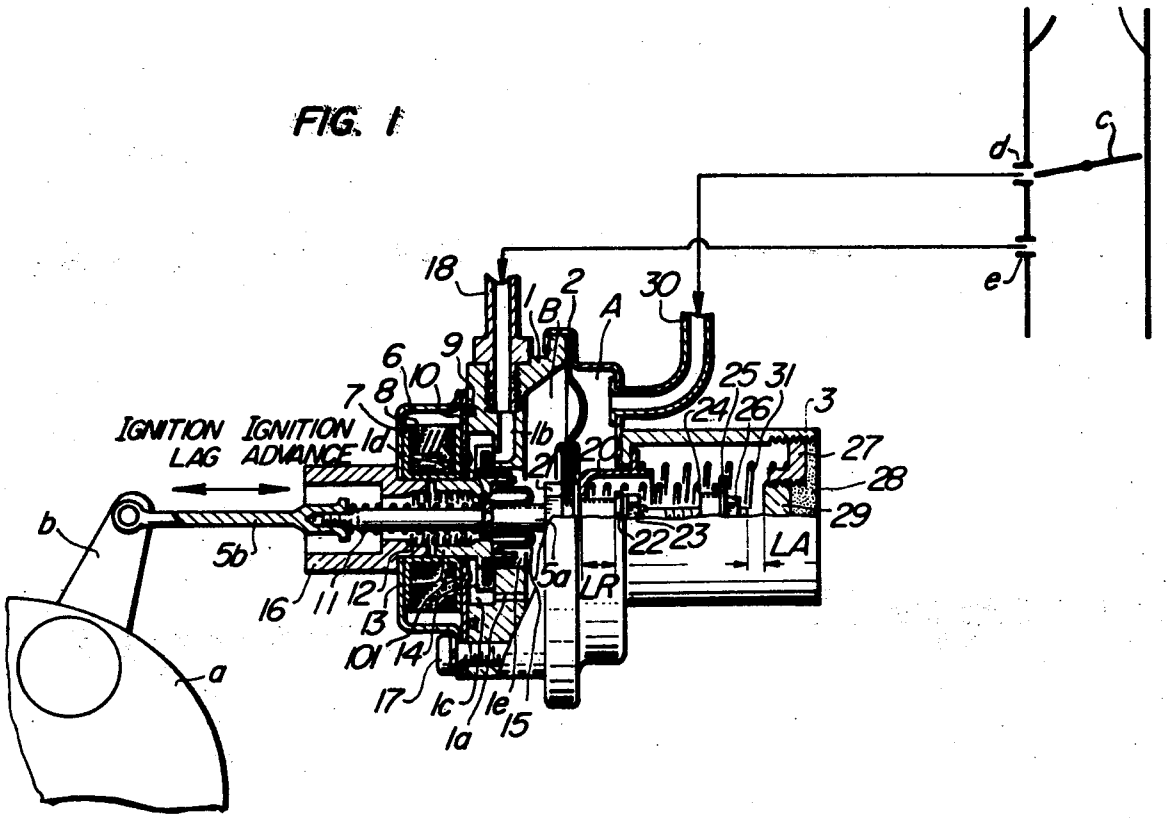
FIG. 1 is a fragmentary sectional schematic view of the ignition timing control device comprising one embodiment of the invention.

The spring seat 27 is formed in its central portion with a threaded opening which is adapted to threadably receive an adjusting screw 29 for adjusting the distance between the rear end of the rod 5*a* and the adjusting screw 29 such that the distance is LA (See FIG. 1). After this adjustment is effected, a bonding agent 28 is poured into a space formed by the end surfaces of the spring seat 27 and the adjusting screw 29 and the open end portion of the spring housing 3 so as to bond these parts together.

The diaphragm case 1 has a large thickness bottom portion which is formed therein with a communication port 1*b* (serving as a negative pressure introducing port) for communicating the diaphragm chamber B with the outside. The case is formed in its central portion with a communication opening 1*e* through which the rod 5*a* extends, and is hollowed out to provide an empty space 1*c*. The communication port 1*b* communicates with the diaphragm chamber B through the communication opening 1*e* and the empty space 1*c*. The bottom portion of the case 1 is further formed with a small opening 1*a* (hereinafter referred to as an atmospheric pressure introducing port), so that the diaphragm chamber B will communicate with the empty space 1*c* through the opening 1*a*, in addition to the communication opening 1*e*. A pressure introducing nipple 18 is threadably fitted in the inlet portion of the communication port 1*b*.

A seal member 15 in the form of a bellowsphragm is secured in airtight relation at its outer peripheral end to the inner peripheral portion of a cylindrical plunger 13 in such a manner that the projecting portion of the seal member 15 is disposed on the diaphragm chamber B side, and the inner peripheral end of the seal member 15 is force fitted over the rod 5*a* and secured in airtight relation to a groove 53 formed in the rod 5*a*.

The plunger 13 is formed in its intermediate portion with a valve means 14 of the flange shape which is disposed in the empty space 1*c* formed in the case 1 by hollowing out. The valve means 14 is of a size which is large enough to cover the open end of the communication port 1*b* facing the empty space 1*c*.

The plunger 13 is loosely fitted with respect to the rod 5*a* and the communication opening 1*e* formed in the case 1, so that the plunger 13 is axially movable along the rod 5*a*.

An annular plate 10 is mounted in spaced juxtaposed relation to the plunger 13, and an O-ring 9 is inserted between the plate 10 and the end of the case 1. An electromagnetic coil 8 wound on a bobbin 7 made of a synthetic resinous material is mounted on the plate 10.

A third spring 12 is mounted in the interior of the cylindrical plunger 13 in such a manner that one end of the spring 12 is positioned against an offset portion formed on its inner peripheral surface. Then a cover 6 is placed on to the electromagnetic coil 8, and the cover 6 and plate 10 are secured to the case 1 by means of a screw 17.

The cover 6 is formed at its central portion with an opening through which the rod 5*a* extends. A cylindrical boss 16 is attached by brazing to the opening in the cover 6 through which the rod 5*a* extends, and is formed on its inner peripheral surface with an offset portion for supporting the other end of the third spring 12. Thus, when the parts are assembled, the third spring 12 is held between the plunger 13 and the boss 16.

Finally, a cap 111 is applied to the forward end portion of the rod 5*a* and forcedly moved inwardly to the position on the rod 5*a* in which the seal member 15 is secured to the rod 5*a*, and a fourth spring 11 is mounted about the rod 5*a* and supported at one end by the cap 111.

The fourth spring 11 is supported at the other end by a portion of the rear end of a rod 5*b* connected to the forward end of the rod 5*a*, the rod 5*b* being connected at the forward end to an ignition timing adjusting plate of a distributor on which an ignition signal generating means is mounted.

A gap 1*d* is formed between the inner end of the annular plate 10 and the outer periphery of the plunger 13, so that the diaphragm chamber B can communicate with the atmosphere through the empty space 1*c* and the atmospheric pressure introducing port 1*a*. However, in the event that the valve means 14 is in engagement with an annular projection 101 of the plate 10, the sealing action of the valve means 14 and the annular projection 101 shuts off the empty space 1*c* from the atmosphere, and at the same time the communication port 1*b* is allowed to communicate with the diaphragm chamber B through the empty space 1*c* and the communication opening 1*e*.

When the electromagnetic coil 8 is not energized, the plunger 13 is urged to move by the biasing force of the third spring 12 to move toward the diaphragm chamber B, so that the valve means 14 closes the communication port 1*b*. Upon energization of the electromagnetic coil 8, the plunger 13 is attracted by the coil and moved away from the diaphragm chamber B by overcoming the biasing force of the third spring 12, so that the valve means 14 is brought into engagement with the annular projection 101 of the plate 10 and opens the communication port 1*b*.

The control device in accordance with the invention is constructed as described above. As shown in FIG. 1, the conduit 30 is connected to a small port d formed in the carburetor and disposed on the upstream side of a throttle valve c in the vicinity thereof so as to introduce the negative pressure on the upstream side of the throttle valve c into the diaphragm chamber A. On the other hand, the nipple 18 is connected to a small port e formed in the suction pipe so as to introduce the negative pressure in the suction pipe into the communication port 1*b*. The rod 5*b* is connected to the ignition timing adjusting plate b of the distributor a on which the ignition signal generating means is mounted. By this arrangement, the control device operates as follows to effect control of ignition timing.

The pressure on the upstream side of the throttle valve c is close to the atmospheric pressure when the throttle valve c is fully closed. However, as the degree of opening of the throttle valve c increases, the pressure is reduced to about 660 mmHg in absolute pressure. The pressure in the suction pipe is about 660 mmHg with the throttle valve c being wide open. However, the pressure is reduced to about 500 to 560 mmHg when the engine is idling, and the pressure is further reduced when the engine is decelerating.

The pressures introduced into the diaphragm chambers A and B fluctuate in the manner described above. This enables the rod 5*a* (connected to the rod 5*b*) to move leftwardly and rightwardly in FIG. 1 in accordance with the pressure differential across the two diaphragm chambers.

It is generally known that if ignition is made to take place 5° to 10° before top dead center when the engine is in normal operating condition or accelerating, the engine can operate in a stable manner, and that if ignition is made to take place 5° to 10° after top dead center when the engine is idling or decelerating, the noxious components of the exhaust emissions, i.e. carbon monoxide and hydrocarbons, can be reduced in amount. The control device in accordance with the invention effects control of ignition timing on the basis of the aforementioned theory.

The control device is set such that when the rod 5*a* (connected to the rod 5*b*) moves rightwardly as indicated by the arrow in FIG. 1 the control device effects ignition advance, and that when the rod 5*a* moves leftwardly as indicated by the arrow in FIG. 1 the control device effects ignition lag.

When the engine operates in normal condition or accelerates, the electromagnetic coil 8 is not energized, so that the valve means 14 closes the communication port 1*b*. Thus, the diaphragm chamber B is maintained in communication with the atmosphere through the gap 1*d*, empty space 1*c* and atmospheric pressure introducing port 1*a*.

On the other hand, the pressure prevailing on the upstream side of the throttle valve *c* is introduced into the diaphragm chamber A through the conduit 30, so that the pressure in the diaphragm chamber B is higher than the pressure in the diaphragm chamber A by about 100 mmHg. This difference in pressure between the two diaphragm chambers causes the diaphragm 19 to be deflected rightwardly in FIG. 1, with a result that the rod 5*a* moves rightwardly by overcoming the biasing force of the second spring 31. This results in an ignition advance.

Conversely, when the engine is idling, this engine operating condition is detected by known means and the electromagnetic coil 8 is energized to attract the plunger 13 thereto. This moves the plunger 13 leftwardly in FIG. 1 and allows the valve means 14 to open the communication port 1*b* and at the same time shut off communication through the gap 1*d* and empty space 1*c* with the atmosphere. Thus, the pressure prevailing in the suction pipe is introduced into the diaphragm chamber B through the nipple 18, communication port 1*b*, empty space 1*c*, communication opening 1*e* and atmospheric pressure introducing port 1*a*.

With the engine idling, the pressure on the upstream side of the throttle valve c in the vicinity thereof with which the diaphragm chamber A communicates is close to the atmospheric pressure, so that the pressure in the diaphragm chamber A becomes higher than the pressure in the diaphragm chamber B by about 200 to 250 mmHg. This difference in pressure between the two diaphragm chambers causes the diaphragm 19 to be deflected leftwardly in FIG. 1, with a result that the rod 5*a* moves leftwardly by overcoming the biasing force of the first spring 24. This results in an ignition lag.

When the engine is decelerating, ignition lag is effected in the same manner as when the engine is idling. However, the pressure in the suction pipe is reduced to 200 to 250 mmHg when the engine is idling. Thus, the difference in pressure between the two diaphragm chambers is greater when the engine is decelerating than when it is idling. With the engine decelerating, the diaphragm is quickly displace leftwardly, enabling a high ignition advance condition to be switched quickly to a high ignition lag condition.

From the foregoing description, it will be appreciated that, in the ignition timing control device in accordance with the invention, a pressure for effecting ignition lag is supplied to one of the two diaphragm chambers formed on opposite sides of a single diaphragm and a pressure for effecting ignition advance is supplied to the other diaphragm chamber, and a change-over valve mechanism forming a unitary structure with one of the two diaphragm cases is effective to increase or decrease the pressure supplied to either one of the diaphragm chambers as desired, so that the diaphragm can be moved in opposite directions to thereby effect ignition advance or ignition lag. The invention makes it possible to obtain an overall compact size in an ignition timing control device which has the two functions of ignition advance and ignition lag.

The change-over mechanism forms a unitary structure with one of the diaphragm cases. This enables the conduit between the change-over valve and the diaphragm to assume the form of a communication opening. This arrangement offers advantages in that the length of the communication passage can be greatly reduced and the pressure leakage can be minimized because of reduced connections in the piping system.

Particularly, the embodiment shown and described herein is constructed such that the electromagnetic coil is arranged concentrically with the rod, and the plunger and the valve are also arranged concentrically with the rod, so that the parts are arranged logically and the space occupied by them can be minimized.

Although an electromagnetic coil is used in the invention, the force required for switching the valve mechanism and moving the same between the two positions is much smaller than the force required for substantially directly operating the diaphragm in the prior art. Thus, the electromagnetic coil used in the invention can be half as large in size as the electromagnetic coil used in the prior art. Moreover, the stroke of the change-over valve means can be as short as 1 mm to enable the control device to operate satisfactorily. Thus, the electromagnetic coil and the change-over valve mechanism are smaller in volume than the corresponding parts of control devices of the prior art wherein an electromagnet is used for directly operating the diaphragm.

In the embodiment shown and described herein, the change-over valve mechanism is formed by utilizing a portion of one of the diaphragm cases. It is to be understood, however, that the change-over valve mechanism can be formed integrally with the plate and mounted on one of the diaphragm cases. Also, the change-over valve means can be formed independently of other parts and inserted between the plate and one of the diaphragm cases.

Particularly, assembling of the parts can be facilitated if the change-over valve means forms a unitary structure with one of the diaphragm cases as described with reference to the embodiment.

In the embodiment shown and described herein, the electromagnetic coil is energized to actuate the change-over valve mechanism in a manner to open the communication port when ignition lag is effected. It is to be understood, however, that the control device can be designed in such a manner that the electromagnetic coil is de-energized to actuate the change-over valve mechanism in a manner to open the communication port when ignition lag is effected.

Furthermore, in the embodiment shown and described herein, the diaphragm chamber having the change-over valve mechanism mounted therein is disposed nearer to the distributor than the other diaphragm chamber. This arrangement is effective to render the control device impervious to influences of vibration, because the center of gravity of the control device is disposed in the vicinity of the distributor.

In the embodiment shown and described herein, a pressure for effecting ignition advance is supplied from the upstream side of the throttle valve of the carburetor in the vicinity thereof, while a pressure for effecting ignition lag is introduced from the suction pipe. It is to be understood, however, that any other pressure source or sources may be used so long as the switching of the change-over valve means between the two positions enables one diaphragm chamber to have a higher pressure than the other diaphragm chamber when ignition advance is effected and the other diaphragm chamber to have a higher pressure than one diaphragm chamber when ignition lag is effected.

I claim:

1. An ignition timing control device of the negative pressure actuation type comprising a diaphragm, two diaphragm cases holding said diaphragm therebetween to define a first diaphragm chamber and a second diaphragm chamber, a rod secured to the diaphragm at its central portion and extending at its forward end portion through the diaphragm on the first diaphragm chamber side, an ignition timing adjusting plate connected to the forward end of said rod, means for mounting an ignition signal generating means on said timing adjusting plate, a communication opening formed in a portion of one of said diaphragm cases through which the forward end portion of the rod extends, said communication opening being concentric with said rod and communicating with said first diaphragm chamber, an annular empty space formed as an extension of said communication opening and disposed concentric with the rod, a negative pressure introducing port disposed adjacent said empty space to communicate with a negative pressure source, an atmospheric pressure introducing port disposed adjacent said empty space to communicate with the atmosphere, an electromagnetically operated annular valve means arranged in said empty space and disposed concentrically with said rod, a seal member mounted between said valve means and said rod, and means for moving said valve means along the rod axially thereof so as to selectively communicate said negative pressure introducing port and said atmospheric pressure introducing port with said first diaphragm chamber.

2. An ignition timing control device of the negative pressure actuation type as claimed in claim 1, wherein the device is mounted in such a manner that the first diaphragm chamber having said valve means mounted therein is disposed on the side of a distributor when the device is used in combination with the ignition timing adjusting plate mounted on the distributor.

3. An ignition timing control device of the negative pressure actuation type as claimed in claim 1, wherein said second diaphragm chamber receives a supply of pressure from a portion of a carburetor which is disposed in the vicinity of a throttle valve and which is disposed opposite to an engine with respect to the value when the throttle valve is fully closed, and said first diaphragm chamber receives a supply of pressure from a suction pipe.

4. An ignition timing controller of the negative pressure actuation type comprising a housing, a diaphragm mounted in said housing so as to divide said housing into first and second diaphragm chambers, a rod secured to a central portion of the diaphragm and extending, at a forward end portion, from the diaphragm through said first diaphragm chamber, and a communication opening formed in said housing, said communication opening communicating with said first chamber, an ignition timing adjustment means, said ignition timing adjustment means being connected to the forward end portion of said rod for advancing and retarding ignition in response to movement of said rod, an empty space formed as an extension of said communicating opening and disposed circumferentially about said rod, a negative pressure introducing port adjacent said empty space for communicating said first chamber with a negative pressure source, an atmospheric pressure introducing port disposed adjacent said empty space for communicating said first chamber with the atmosphere, an electromagnetically operated valve means positioned in said empty space and disposed circumferentially about said rod, a seal member mounted between said valve means and said rod, and means for moving said valve means axially along said rod so as to selectively communicate said negative pressure introducing and said atmospheric pressure introducing ports with said first diaphragm chamber for displacing said diaphragm, and with it said rod, to thereby operate said ignition timing adjustment means.

5. An injection timing controller according to claim 4, wherein said seal member is a bellows-like diaphragm secured to said rod and said valve means.

* * * * *